US008234871B2

(12) United States Patent
Davis, Jr. et al.

(10) Patent No.: US 8,234,871 B2
(45) Date of Patent: Aug. 7, 2012

(54) METHOD AND APPARATUS FOR DELIVERY OF A FUEL AND COMBUSTION AIR MIXTURE TO A GAS TURBINE ENGINE USING FUEL DISTRIBUTION GROOVES IN A MANIFOLD DISK WITH DISCRETE AIR PASSAGES

(75) Inventors: Lewis Berkley Davis, Jr., Niskayuna, NY (US); Thomas Edward Johnson, Greer, SC (US); Jason Thurman Stewart, Greer, SC (US)

(73) Assignee: General Electric Company, Schenectady, NY (US)

( * ) Notice: Subject to any disclaimer, the term of this patent is extended or adjusted under 35 U.S.C. 154(b) by 761 days.

(21) Appl. No.: 12/406,216

(22) Filed: Mar. 18, 2009

(65) Prior Publication Data

US 2010/0236247 A1 Sep. 23, 2010

(51) Int. Cl.
*F02C 7/22* (2006.01)

(52) U.S. Cl. ..... 60/737; 60/740; 60/742; 60/748; 60/776

(58) Field of Classification Search ..... 60/737, 60/738, 740, 746, 747, 748, 776; 239/424.5, 239/424, 425, 431, 430, 429
See application file for complete search history.

(56) References Cited

U.S. PATENT DOCUMENTS

| | | | | |
|---|---|---|---|---|
| 2,812,212 | A * | 11/1957 | Rogers et al. | 239/430 |
| 3,608,833 | A * | 9/1971 | Hankins et al. | 239/430 |
| 4,100,733 | A * | 7/1978 | Striebel et al. | 60/737 |
| 4,262,482 | A * | 4/1981 | Roffe et al. | 60/738 |
| 4,455,840 | A * | 6/1984 | Matt et al. | 60/737 |
| 5,000,004 | A * | 3/1991 | Yamanaka et al. | 60/738 |
| 5,303,542 | A * | 4/1994 | Hoffa | 60/746 |
| 6,438,961 | B2 | 8/2002 | Tuthill et al. | |
| 6,763,663 | B2 * | 7/2004 | Mansour et al. | 60/740 |
| 6,920,749 | B2 * | 7/2005 | Mansour et al. | 239/424.5 |
| 7,007,477 | B2 | 3/2006 | Widener | |
| 7,137,258 | B2 | 11/2006 | Widener | |
| 7,546,740 | B2 * | 6/2009 | Chen et al. | 60/776 |

* cited by examiner

*Primary Examiner* — Ehud Gartenberg
*Assistant Examiner* — Lorne Meade
(74) *Attorney, Agent, or Firm* — Cantor Colburn LLP

(57) ABSTRACT

A nozzle has combustion air passages extending from a first, upstream end to a second, downstream end. A fuel distribution manifold is associated with the first, upstream end of the nozzle. Combustion air passages correspond to, and align with the air passages in the nozzle. Fuel distribution grooves are formed in one end of the fuel distribution manifold disk and extend from a central opening to the air passages. A fuel circuit cover closes the fuel distribution grooves to define fuel passages that extend from the central opening to the combustion air passages. A fuel supply conduit communicates with the central opening and the fuel passages for delivery of fuel to the combustion air in the air passages.

18 Claims, 7 Drawing Sheets

Prior Art

METHOD AND APPARATUS FOR DELIVERY OF A FUEL AND COMBUSTION AIR MIXTURE TO A GAS TURBINE ENGINE USING FUEL DISTRIBUTION GROOVES IN A MANIFOLD DISK WITH DISCRETE AIR PASSAGES

BACKGROUND OF THE INVENTION

The subject matter disclosed herein relates to combustion systems for gas turbine engines. Manufacturers and operators of gas turbine engines desire to produce and operate gas turbines that will operate at high efficiency while producing reduced quantities of governmentally regulated combustion constituents. The primary regulated exhaust gas constituents produced by gas turbine engines burning conventional hydrocarbon fuels are oxides of nitrogen ("NOx"), carbon monoxide ("CO") and unburned hydrocarbons ("HC"). The oxidation of nitrogen in internal combustion engines is dependant upon the maximum hot gas temperature in the combustion system reaction zone. The rate of chemical reactions forming oxides of nitrogen is a function of temperature. Controlling the temperature of combustion in the combustion chamber to a desired temperature will assist in controlling the formation of NOx components.

One method of controlling the temperature of the combustion system reaction zone in a turbine engine combustor, to a level that will limit the formation of NOx constituents, is to pre-mix fuel and combustion air to a "lean" mixture prior to combustion. The thermal mass of the excess air present in the reaction zone of the combustor will absorb heat and reduce the temperature of the combustion event.

Operational issues involved with combustors operating with lean pre-mixing of fuel and air involve the presence of combustible mixtures within the pre-mixing sections of the combustor, upstream of the combustor reaction zone. In such cases, combustion may occur within the pre-mixing section due to an effect referred to as "flashback" that may occur when the flame from the combustion zone propagates into the pre-mixing section of the combustor. Additionally, auto ignition may occur when the dwell time and temperature of the air/fuel mixture in the premixing section is sufficient for combustion to be initiated without an igniter. Results of combustion occurring within the premixing zone of the combustor may include degradation of emissions performance of the gas turbine engine and/or overheating of the combustor premixing section and lower than desirable durability.

In addition, the mixture of fuel and air exiting the pre-mixer section and entering the reaction zone of the combustor should be uniform so as to achieve the desired emissions performance. If regions exist in the air/fuel flow field where the concentration of fuel versus air is richer than in other regions, the products of combustion in these rich regions may attain a higher combustion temperature and, as a result, a higher level of NOx. Alternatively, regions in the air/fuel flow field where the concentration of fuel versus air is leaner than in other regions may lead to quenching, with a failure to oxidize hydrocarbons and or carbon monoxide, leading to higher than desired CO and HC emissions levels.

It is therefore desirable to obtain a combustor for a gas turbine engine having features that allow a reduction in the emission of regulated constituents with satisfactory performance and durability.

BRIEF DESCRIPTION OF THE INVENTION

According to one aspect of the invention, a nozzle assembly is disclosed having a nozzle and combustion air passages extending from a first, upstream end to a second, downstream end. A fuel distribution manifold disk attaches to the first, upstream end of the nozzle and may include an opening extending therethrough. Combustion air passages extend from a first, upstream end to a second, downstream end corresponding to, and in alignment with the air passages in the nozzle. Fuel distribution grooves may be formed in one end of the fuel distribution manifold disk and extend from the opening to the air passages. A fuel circuit cover has combustion air passages extending from a first, upstream end to a second, downstream that correspond to, and align with, the air passages in the fuel distribution manifold disk. The fuel circuit cover closes the fuel distribution grooves to define fuel passages that extend from the opening to the combustion air passages. A fuel supply conduit communicates with the opening and the fuel passages for delivery of fuel to the combustion air in the air passages.

These and other advantages and features will become more apparent from the following description taken in conjunction with the drawings.

BRIEF DESCRIPTION OF THE DRAWINGS

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
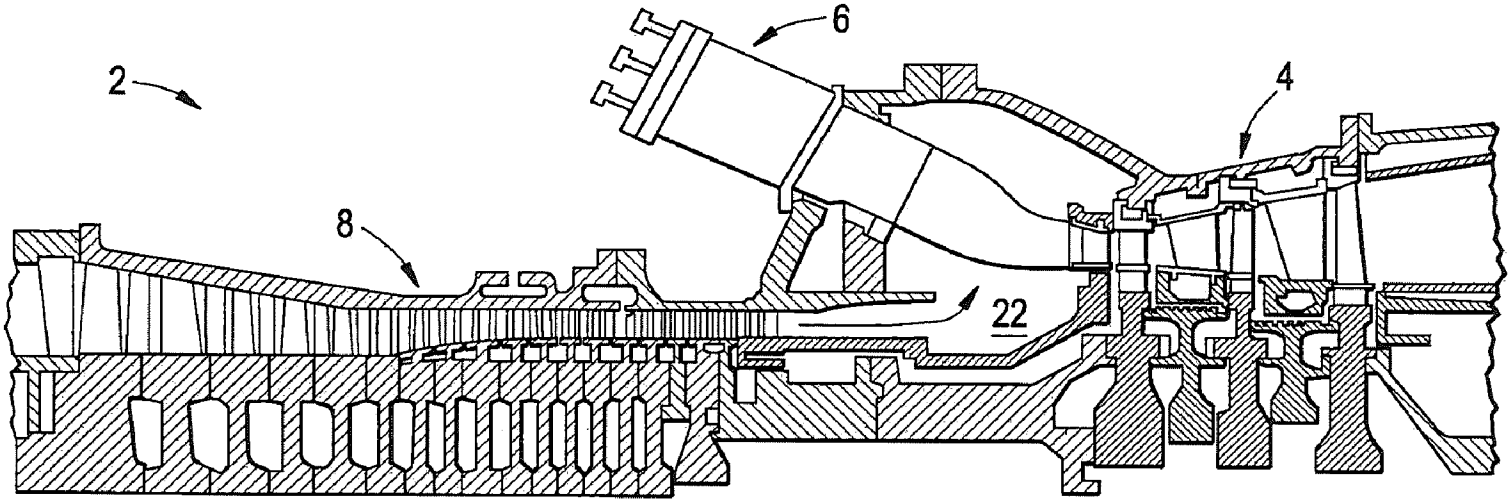
FIG. 1 is a sectional view of a gas turbine engine to which an embodiment of the invention may be applied.
Figure 2:
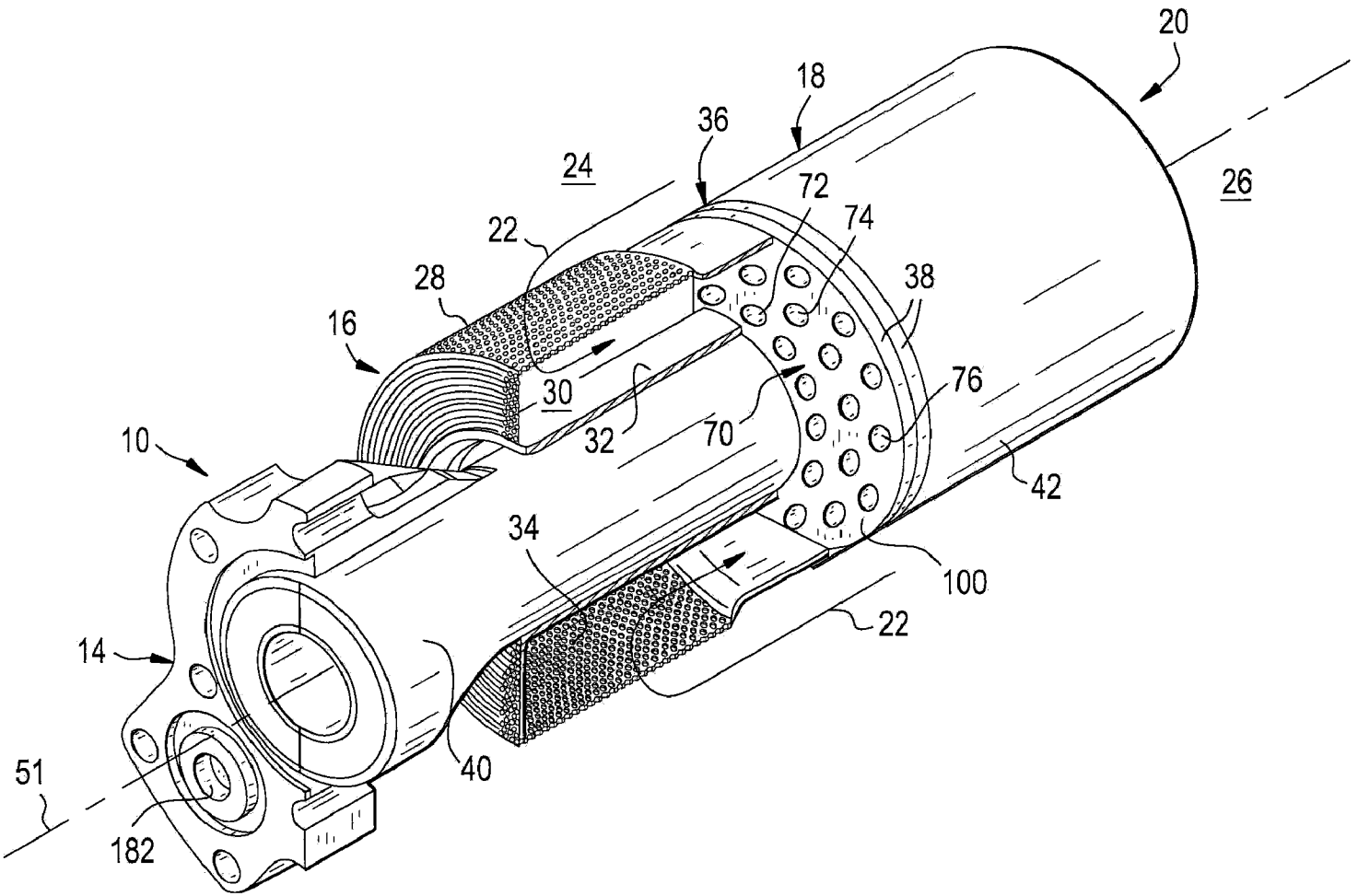
FIG. 2 is an isometric, partially sectioned view of a burner assembly embodying features of the invention.

In one, non-limiting embodiment of the invention shown in FIGS. 1 and 2, a gas turbine engine 2 comprises a turbine 4, a combustor 6 and a compressor 8 for delivery of compressed combustion air 22 to the combustor. The combustor 6 combusts fuel with the combustion air to deliver hot combustion gas through an outlet to the turbine 4.

A burner assembly 10 for installation in to the combustor 6 of a gas turbine engine 2 is shown. The burner assembly 10 comprises four primary sections, by function, including a fuel inlet and distribution manifold assembly 14, an air inlet and flow conditioner assembly 16, a fuel nozzle assembly 18 and an outlet zone 20. Combustion air 22 enters the burner assembly from a high-pressure plenum 24 surrounding the entire assembly, with the exception of the outlet zone 20 that is disposed within the combustor reaction zone 26 of the combustor 6. The combustion air 22 for the burner assembly 10 enters the air inlet and flow conditioner assembly 16 via the inlet flow conditioner 28. The inlet flow conditioner may include an annular flow passage 30 that is bounded by a cylindrical inner wall 32 at its inside radius and a perforated cylindrical outer wall 34 at its outer radius. Combustion air 22 enters the air inlet and flow conditioner assembly 16 via the perforations in the cylindrical outer wall 34 of the flow conditioner 16. The inlet flow conditioner operates to evenly distribute the flow of combustion air 22 for entry into the fuel nozzle assembly 18. The inlet flow conditioner 16 may be used in the burner assembly 10 for the described purpose but may not be necessary, depending upon the particular application and, specifically, the flow characteristics of the combustion air supply.

Following entry of the combustion air 22 in to the air inlet and flow conditioner assembly 16, the flow is directed towards the fuel nozzle assembly 18 that extends between the annular flow passage 30 and the outlet zone 20 of the burner assembly 10. The fuel nozzle assembly, is the mechanism through which fuel and air are pre-mixed prior to discharge into the combustor reaction zone 26, where the mixture is burned. The nozzle assembly 18 comprises an air fuel manifold assembly 36 that operates to mix fuel with combustion air 22 at desired circumferential and radial locations in the assembly, as well as to regulate the air/fuel mixture. The air fuel manifold assembly 36 includes one or more fuel distribution manifold disks 38 and an annular fuel delivery hub or conduit 40 associated with the fuel distribution manifold disks 38. The fuel distribution manifold disk or disks 38 are configured for attachment to a first, upstream end of the nozzle 42 and operate to deliver fuel, such as natural gas, to the compressed combustion air 22 flowing therethrough.

Figure 3:
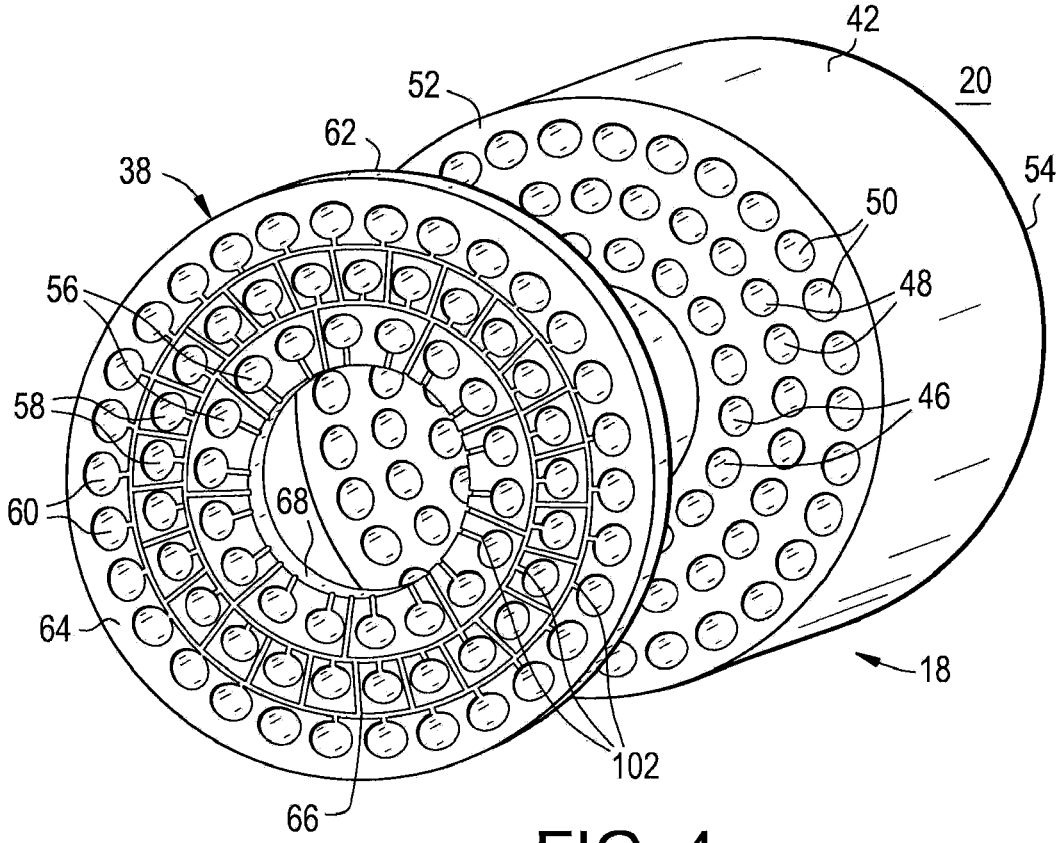
FIG. 3 is an isometric, partially exploded view of a nozzle assembly associated with the burner assembly of FIG. 2.
Figure 4:
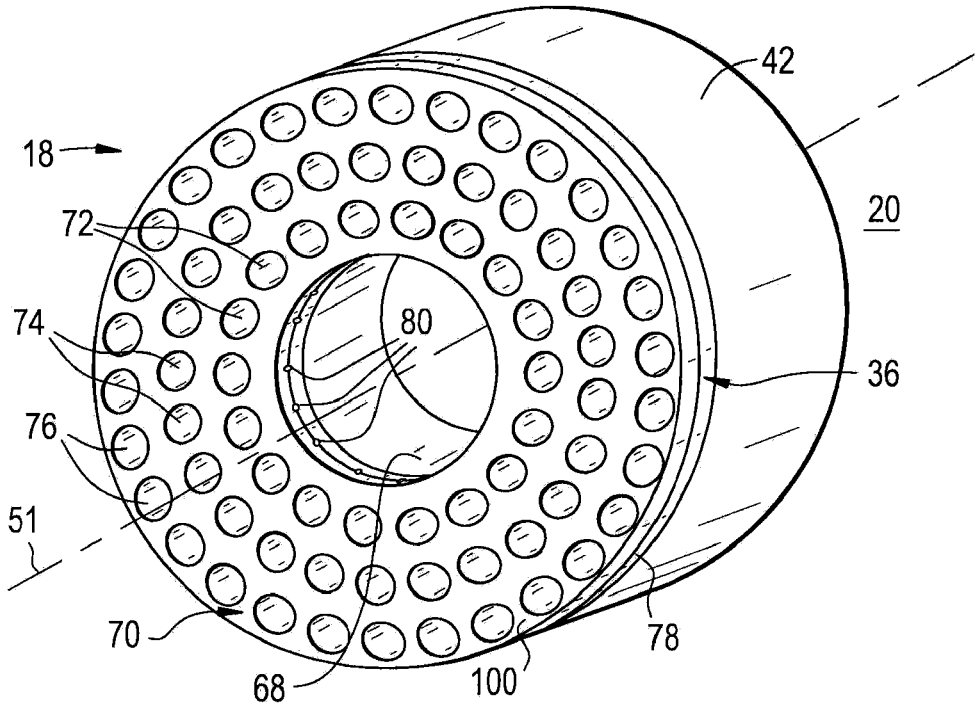
FIG. 4 is an isometric view of the nozzle assembly of FIG. 3.

In a non-limiting, exemplary embodiment illustrated in FIGS. 3 and 4, a fuel nozzle assembly having a single fuel circuit is shown. The fuel nozzle assembly 18 includes a nozzle 42 having three sets of discrete, circumferentially and radially spaced flow passages 46, 48, and 50, respectively (i.e. inner, intermediate and outer flow passages). In the embodiment shown, the flow passages extend axially through the nozzle 42 from a first, upstream end 52 to a second, downstream end 54. Depending upon desired combustion characteristics, the flow passages may extend axially parallel to the center axis 51 of the nozzle or, as illustrated in the sectional view of FIG. 6, may be angled relative to the axis 51 in order to affect the fuel/air mixing, distribution and flow characteristics of the fuel/air mixture exiting the nozzle 42, at outlet zone 20, and entering the combustor reaction zone 26. The nozzle 42 may be constructed of any suitable material having properties that exhibit strength and durability in high temperature environments such as steel or ceramic. Additionally the nozzle 42 may be machined of bar stock with flow passages machined therein or near-net-shape-cast to reduce cost, handling and potential part-to-part variation.

Associated with the upstream end 52 of the fuel nozzle 42 is a fuel distribution manifold disk 38 having, in a manner similar to fuel nozzle 42, three sets of circumferentially and radially spaced flow passages 56, 58, and 60, respectively (i.e. inner, intermediate and outer flow passages) that extend axially through the fuel distribution manifold disk from a first, upstream end 64, to a second, downstream end 62. The flow passages are configured to closely complement the fuel nozzle flow passages in the fuel nozzle 42 when the downstream end 62 of the fuel distribution manifold disk 38 is placed adjacent to, and in alignment with the upstream end 52 of the fuel nozzle 42. Upstream end 64 of the fuel distribution manifold disk 38 includes a series of fuel distribution passages or channels 66 which extend in a generally radial direction from central opening 68 to intersect each of the inner, intermediate and outer flow passages 56, 58, and 60 respectively.

Associated with the upstream end 64 of the manifold disk 38 is fuel circuit cover plate 70 having, in a manner similar to fuel nozzle 42 and fuel distribution manifold disk 38, three sets of circumferentially and radially spaced flow passages 72, 74, and 76, respectively (i.e. inner, intermediate and outer flow passages) that extend axially through the fuel circuit cover plate and are configured to closely complement the flow passages in the fuel distribution manifold disk when the downstream end 78 of the fuel circuit cover plate is placed adjacent to, and in alignment with the upstream end 64 of the fuel distribution manifold disk 38. The downstream end 78 has a flat surface (not shown) extending between the flow passages 72, 74 and 76 which operates to close the fuel distribution grooves 66 thereby defining a closed, fuel distribution conduit, the inlets of which communicate with central opening 68 and are shown at 80. The fuel distribution conduit, defined by the fuel distribution grooves and the fuel circuit cover plate 70, extend in a generally radial direction from central opening 68 to intersect each of the inner, intermediate and outer flow passages 56, 58, and 60 respectively of fuel manifold disk 38. Central opening 68 may define a portion of a fuel circuit through which fuel from annular fuel delivery conduit 40 may be delivered to the inlets 80 of the fuel distribution conduit.

In another embodiment of the invention, it is contemplated that the fuel distribution manifold disc 38 may be reversed such that the first, upstream face 64 is placed against the first, upstream end 52 of the fuel nozzle 42. In this configuration, the upstream end 52 has a flat surface extending between the flow passages 46, 48 and 50 which operates to close the fuel distribution grooves 66 thereby defining a closed, fuel distribution conduit, the inlets of which communicate with central opening 68. The fuel distribution conduit defined by the fuel distribution grooves and the first, upstream end 52 of the nozzle 42 extend in a generally radial direction from central opening 68 to intersect each of the inner, intermediate and outer flow passages 56, 58, and 60 respectively of fuel manifold disk 38 but dispenses with the requirement of fuel circuit cover plate 70 thereby simplifying complexity of the nozzle assembly 18. Central opening 68 may define a portion of a fuel circuit through which fuel from annular fuel delivery conduit 40 may be delivered to the inlets 80 of the fuel distribution conduit.

During operation of a burner assembly 10 utilizing the non-limiting, exemplary embodiment illustrated in FIGS. 3 and 4 of a fuel nozzle assembly 18 having a single fuel circuit, combustion air 22 flows through the high-pressure plenum 24 of the combustor, FIG. 2, and enters the air inlet and flow conditioner assembly 16 through the inlet flow conditioner 28. The inlet flow conditioner operates to improve the air flow velocity distribution through the annular flow passage 30 which improves the uniformity of the fuel air mixture ultimately exiting the swirl stabilized nozzle assembly 18.

Combustion air 22 moves axially through the annular flow passage 30 to impinge on the upstream end face 100 of the fuel circuit cover plate 70. Similar to the operation of the inlet flow conditioner 28, the distribution of inner, intermediate and outer discrete flow passages 72, 74 and 76 respectively, in the fuel circuit cover plate as well as corresponding flow passages in the fuel distribution manifold disk 38 and the fuel nozzle 42 operate to "backpressure" the combustion air 22 before it enters the fuel nozzle assembly 18, allowing for a radially and circumferentially even distribution of combustion air entering the inner, intermediate and outer flow passages. The described uniform distribution of combustion air 22 will benefit fuel/air mixing in the nozzle assembly and, provide for even combustion in the combustor reaction zone 26, downstream of the burner assembly 10.

Figure 7:
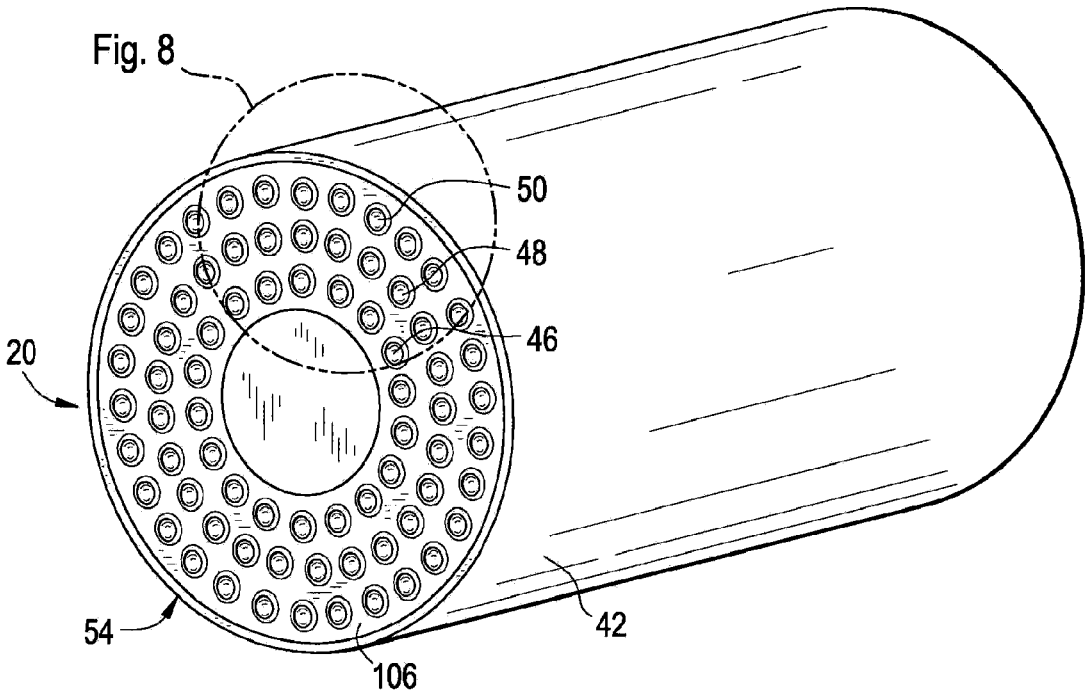
FIG. 7 is an isometric view of the downstream end of the nozzle assembly of FIG. 3.
Figure 8:
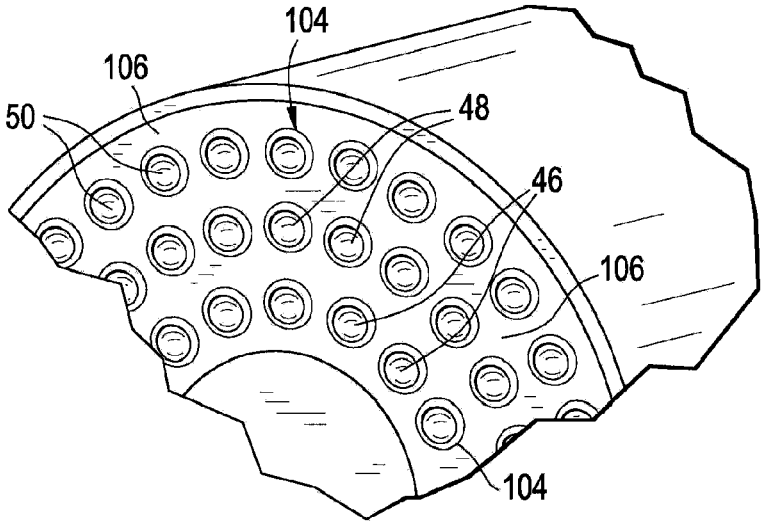
FIG. 8 is an enlarged view of a portion of the downstream end of the nozzle assembly of FIG. 7 taken at circle 8.

Upon entry into the discrete flow passages 72, 74, 76, the air in each passage intersects an outlet 102, FIG. 3, of the fuel distribution conduit 80 allowing fuel exiting each outlet to mix with the combustion air 22 in the flow passages, resulting in an air/fuel mixture which is suitable for combustion in the combustor reaction zone 26. As the fuel air/mixture enters the nozzle 42 it may be subjected to a substantial mixing event as it encounters the fuel inner, intermediate and outer flow passages 46, 48, and 50 respectively, thus assuring that a homogeneous fuel/air mixture exits the flow passages from the downstream end 54 at outlet zone 20. Referring to FIGS. 7 and 8, the outlet zone 20 comprises the downstream end 54 of the nozzle 42 that includes outlets of the nozzle flow passages 46, 48 and 50. Depending on the particular application of the burner assembly 10, it may be desirable to modify the flow passage exits to minimize the flat surface area, or webbing 106, between the outlets thereby reducing the flame attachment area and the possibility of flame holding by the downstream end 54 of the nozzle 42. Such edge-blending 104 may also be employed at the upstream end of the fuel nozzle assembly 18 to allow for increased efficiency of air entrance into the flow passages 72, 74 and 76 of the fuel circuit cover plate 70.

Figure 5:
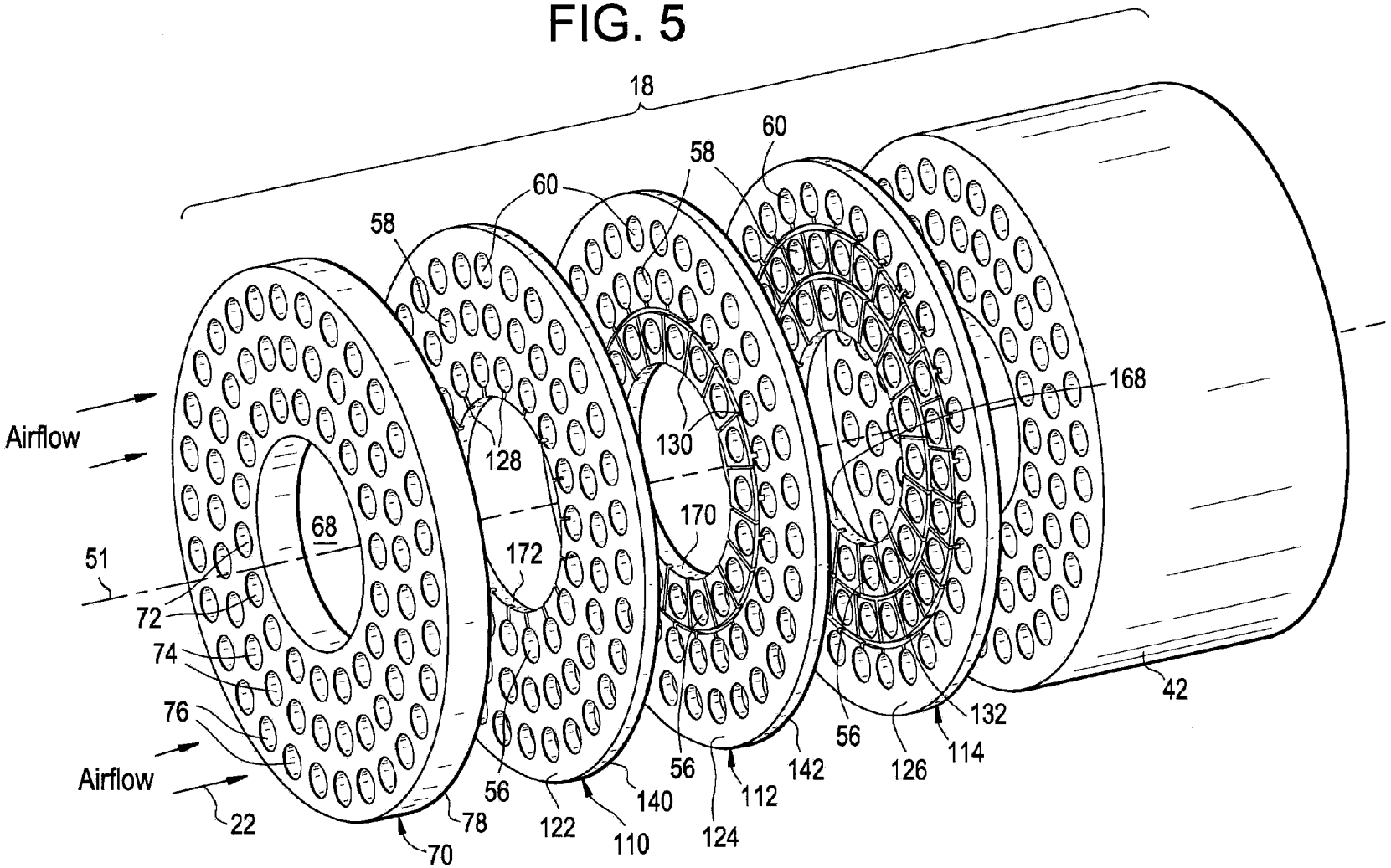
FIG. 5 is an isometric, partially exploded view of another embodiment of the nozzle assembly associated with the burner assembly of FIG. 2.
Figure 6:
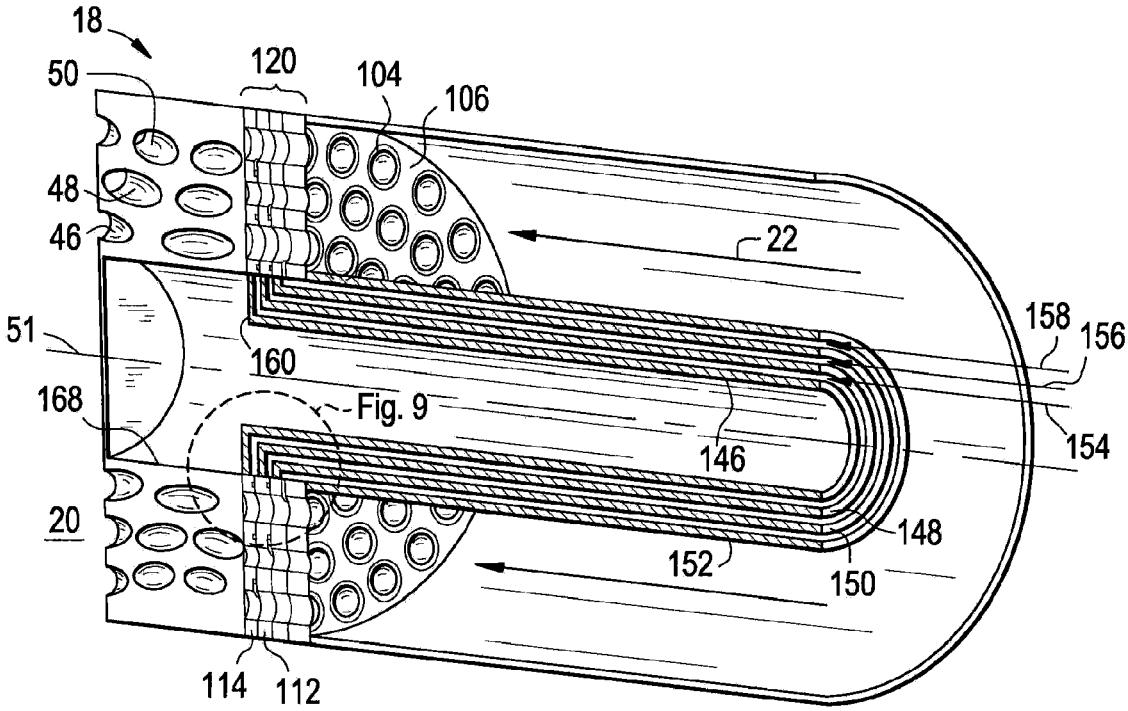
FIG. 6 is an sectional view of a portion of the burner assembly of FIG. 2.
Figure 9:
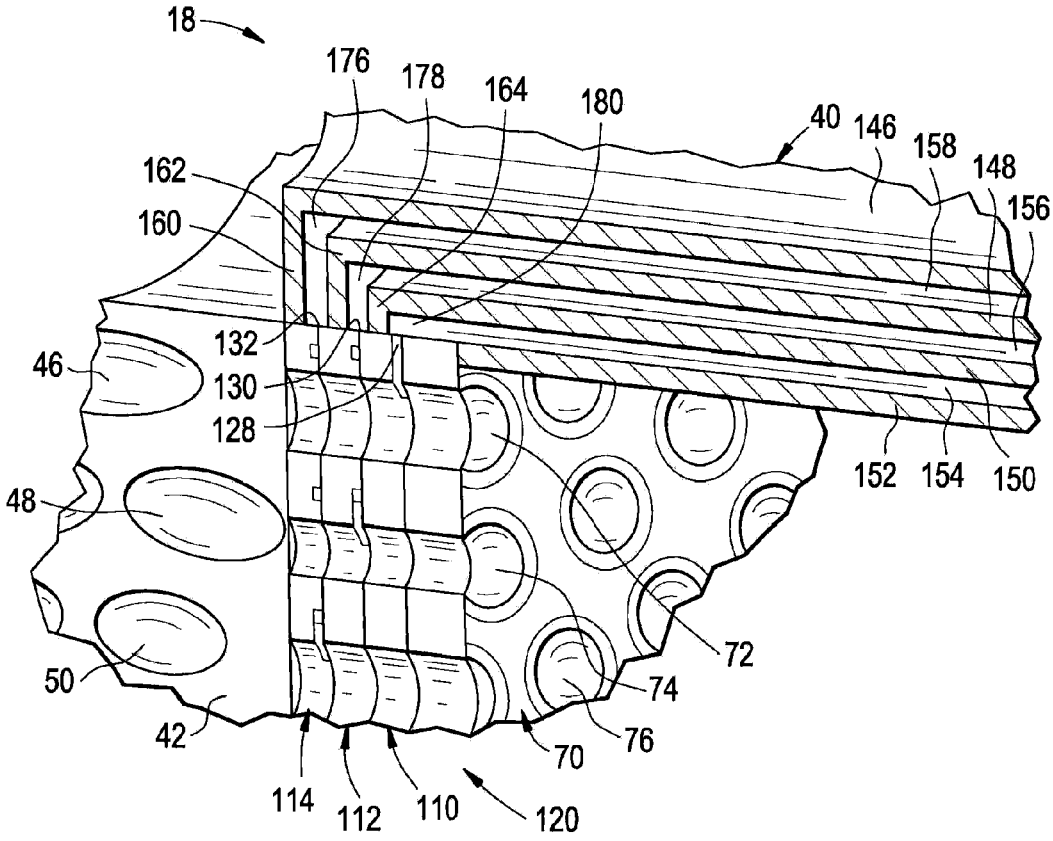
FIG. 9 is an enlarged view of a portion of the burner assembly of FIG. 6 taken at circle 9.

Referring now to FIGS. 5, 6 and 9, in another non-limiting embodiment in which like numerals represent like features already described, fuel nozzle assembly 18 is shown having multiple fuel circuits for improved resolution of the air/fuel mixture. The embodiment shows three fuel manifold disks 110, 112, 114 that, when assembled together in face-to-face engagement, define a fuel manifold assembly 120. Each of the fuel manifold disks include corresponding inner, intermediate and outer discrete flow passages 56, 58 and 60 respectively which are configured in circumferential and radial alignment so as to allow for seamless flow of combustion air 22 through the fuel manifold assembly 120 and associated nozzle 42 upon assembly of the nozzle assembly 18.

The upstream end 122 of the fuel distribution manifold disk 110 includes a series of fuel distribution grooves or channels 128 which extend in a generally radial direction from central opening 68 and intersect each of the inner, flow passages 56. Similarly, the upstream end 124 of the fuel distribution manifold disk 112 includes a series of fuel distribution grooves or channels 130 which extend in a generally radial direction from central opening 68 and intersect each of the intermediate flow passages 58 and, the upstream end 126 of the fuel distribution manifold disk 114 includes a series of fuel distribution grooves or channels 132 which extend in a generally radial direction from central opening 68 and intersect each of the outer flow passages 60.

Associated with the upstream end 122 of the manifold disk 110 is fuel circuit cover plate 70 having, in a manner similar to fuel nozzle 42 and fuel distribution manifold disks 110, 112 and 114, three sets of circumferentially and radially spaced discrete flow passages 72, 74, and 76, respectively (i.e. inner, intermediate and outer flow passages) which are configured to closely complement the flow passages in the fuel distribution manifold disk when the downstream end 78 of the fuel circuit cover plate is placed adjacent to, and in alignment with the upstream end 122 of the fuel distribution manifold disk 110. The downstream end 78 has a flat surface extending between the discrete flow passages 72, 74 and 76 which operates to close the fuel distribution grooves 128 thereby defining a fuel distribution conduit which extends in a generally radial direction from central opening 68 to intersect each of the inner flow passages 56 of fuel manifold disk 110. In like fashion the downstream end 140 of the fuel manifold disk 110 has a flat surface extending between the discrete flow passages 56, 58 and 60 which operates to close the fuel distribution grooves 130 of fuel manifold disk 112, thereby defining a fuel distribution conduit which extends in a generally radial direction from central opening 68 to intersect each of the intermediate flow passages 130 of fuel manifold disk 112 and the downstream end 142 of the fuel manifold disk 112 has a flat surface extending between the discrete flow passages 56, 58 and 60 which operates to close the fuel distribution grooves 132 thereby defining a fuel distribution conduit which extends in a generally radial direction from central opening 68 to intersect each of the outer flow passages 60 of fuel manifold disk 114.

In this embodiment, annular fuel delivery hub 40 may be defined by a series of concentric tubular members; inner tubular member 146, first intermediate tubular member 148, second intermediate tubular member 150 and outer tubular member 152. The tubular members are radially spaced from one another to define discrete fuel delivery channels 154, 156 and 158, therebetween. Inner tubular member 146 terminates at radial end cap 160 that is sealingly fixed about the circumference of central opening 168 of fuel distribution manifold disk 114. First intermediate tubular member 148 is similarly terminated at radial end cap 162 that is sealingly fixed about the circumference of central opening 170, FIG. 5, of fuel distribution manifold disk 112. Radial end caps 160 and 162 are axially spaced from one another to define a radially extending fuel delivery passage 176 therebetween that encompasses the inner ends of the fuel distribution grooves 132. Fuel delivered to the inlet 182, FIG. 2, of the axially extending fuel circuit 40 moves in a downstream direction through the annular fuel delivery channel 158 to the radially extending fuel delivery passage 176 where it enters the fuel distribution conduit 132 for delivery, through the conduit, to each of the outer flow passages 60 extending axially through the swirl stabilized nozzle assembly 18 from the upstream end of the fuel circuit cover plate 70, through the fuel distribution manifold disks and the nozzle 42.

In a similar manner, second intermediate tubular member 150 terminates at radial end cap 164, which is sealingly fixed about the circumference of central opening 172 of fuel distribution manifold 110. Radial end caps 162 and 164 are axially spaced from one another to define a radially extending fuel delivery passage 178 therebetween, which encompasses the inner ends of the fuel distribution conduit 130. Fuel delivered to the inlet end 182 of the axially extending fuel circuit 40 moves in a downstream direction through the annular fuel delivery channel 156 to the radially extending fuel delivery passage 178 where it enters the fuel distribution conduit 130 for delivery, through the conduit, to each of the intermediate flow passages 58 extending axially through the swirl stabilized nozzle assembly 18 from the upstream end of the fuel circuit cover plate 70, through the fuel distribution manifold disks and the nozzle 42.

Additionally, outer tubular member 152 terminates adjacent to fuel circuit cover plate 70 that is sealingly fixed about the circumference of central opening 68 of fuel circuit cover plate 70. Radial end cap 164 and outer tubular member 152 are axially spaced from one another to define fuel delivery passage 180 therebetween that encompasses the inner ends of the fuel distribution conduit 128. Fuel delivered to the inlet end 182 of the axially extending fuel circuit 40 moves in a downstream direction through the annular fuel delivery channel 154 to the fuel delivery passage 180 where it enters the fuel distribution conduit 128 for delivery, through the conduit, to each of the inner air flow passages extending axially through the swirl stabilized nozzle assembly 18 from the upstream end of the fuel circuit cover plate 70, through the fuel distribution manifold disks and the nozzle 42.

The embodiment just described defines three separate fuel circuits including fuel delivery channels 154, 156 and 158 that independently deliver fuel to the various radial flow passages 128, 130 and 132. The use of separate fuel flow circuits allows the fuel delivery to be varied within the fuel nozzle assembly 18 by applying varying flow pressures and or volumes in each fuel delivery channel and, consequently, to corresponding fuel distribution conduits 128, 130 and 132. In addition the relative diameters of fuel distribution conduits 128, 130 and 132 may be varied to allow varying volumetric flow to the different radially space airflow paths if desired. The use of the multiple fuel manifold disks allows the designer to achieve precise air/fuel ratios that may be customized for a particular application. Also, it is contemplated that the axial length, or thickness of the individual fuel manifold disks 110, 112 and 114 may be varied in order to vary the fuel residence time in order to address dynamic issues in the combustor such as vibration, which may lead to hardware durability concerns.

The various embodiments of the present invention have been shown to provide a burner assembly for use in a combustor for a gas turbine engine having operational characteristics that allow reduced emission of regulated constituents with satisfactory performance and durability. The burner assembly may be configured with a single fuel circuit, or with multiple fuel circuits that allow for increased control over air and fuel distribution throughout the nozzle assembly, both radially and circumferentially if desired. It has been shown that the flow passages through the nozzle assembly may vary from parallel to the axis of the nozzle to any angle that results in a desired swirl profile, as well as radial expansion of the air/fuel mixture entering the combustor reactor zone 26 from the burner assembly 10.

While the fuel nozzle assembly has been illustrated in the various figures and above description as having three sets of radially and circumferentially spaced air flow passages extending from an inlet to an outlet end in a relatively evenly spaced configuration, it is contemplated that the distribution of the flow passages, as well as the diameters of the individual flow passages, may be varied for purposes of customizing air and fuel delivery as well as to reduce flame holding at the nozzle outlet.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A nozzle assembly comprising:

a nozzle having discrete combustion air passages extending from a first, upstream end to a second, downstream end;

a fuel distribution manifold disk attached to the first, upstream end of the nozzle having a central opening extending therethrough and having discrete combustion air passages extending from a first, upstream end to a second, downstream end corresponding to, and in alignment with, the discrete combustion air passages in the nozzle;

fuel distribution grooves located in one end of the fuel distribution manifold disk extending from the central opening to the discrete combustion air passages to define a fuel circuit;

a fuel circuit cover having discrete combustion air passages extending from a first, upstream end to a second, downstream end corresponding to, and in alignment with, the discrete combustion air passages in the fuel distribution manifold disk and operable to close the fuel distribution grooves to thereby define fuel passages extending from the central opening to the discrete combustion air passages; and a fuel delivery channel in communication with the central opening and the fuel passages for delivery of fuel to the combustion air in the discrete combustion air passages.

2. The nozzle assembly claim 1, wherein the fuel distribution grooves are formed in the second, downstream end of the fuel distribution manifold disk and the fuel circuit cover is the first, upstream end of the nozzle.

3. The nozzle assembly of claim 1, wherein the fuel distribution grooves are formed in the first, upstream end of the fuel distribution manifold disk and the fuel circuit cover is configured as a second plate attached to the first, upstream end of the fuel distribution manifold disk.

4. The nozzle assembly of claim 1, wherein the discrete combustion air passages extend at an angle to a central axis of the nozzle.

5. The nozzle assembly of claim 4, wherein the angled, discrete combustion air passages are configured to impart a swirl motion to a fuel and combustion air mixture exiting the nozzle at the second, downstream end.

6. The nozzle assembly of claim 1, wherein the discrete combustion air passages extend parallel to a central axis of the nozzle.

7. The nozzle assembly of claim 6, wherein the discrete combustion air passages are configured to establish a fuel and combustion air mixture exiting the nozzle at the second, downstream end.

8. The nozzle assembly of claim 1, wherein the discrete combustion air passage outlets at the second, downstream end of the nozzle have blended edges configured to reduce flame holding at the downstream end of the nozzle.

9. A nozzle assembly comprising:

a nozzle having a first series of discrete combustion air passages extending from a first, upstream end to a second, downstream end, and a second series of discrete combustion air passages extending from the first, upstream end to the second, downstream end;

a first fuel distribution manifold disk attached to the first, upstream end of the nozzle having a central opening extending therethrough and having discrete combustion air passages extending from a first, upstream end to a second, downstream end corresponding to, and in alignment with both the first and the second series of discrete combustion air passages in the nozzle;

first fuel distribution grooves formed in the first, upstream end of the first fuel distribution manifold disk extending from the central opening to the first series of discrete combustion air passages;

a second fuel distribution manifold disk attached to the first, upstream end of the first fuel distribution manifold disk and operable to close the first fuel distribution grooves to thereby define first fuel conduits extending from the central opening to the first series of discrete combustion air passages, the second fuel distribution manifold disk having a central opening extending therethrough and having discrete combustion air passages extending from a first, upstream end to a second, downstream end corresponding to, and in alignment with both the first and the second series of discrete combustion air passages in the nozzle;

second fuel distribution grooves formed in one end of the second fuel distribution manifold disk extending from the central opening to the second series of discrete combustion air passages;

a fuel circuit cover attached to the first, upstream end of the second fuel distribution manifold disk and operable to close the second fuel distribution grooves to thereby define a second fuel conduit extending from the central opening to the second series of discrete combustion air passages, the fuel circuit cover having a central opening extending therethrough and having discrete combustion air passages extending from a first, upstream end to a second, downstream end corresponding to, and in alignment with, both the first and the second series of discrete combustion air passages in the second fuel distribution manifold disk; and a fuel delivery hub in communication with the central openings and the first and second fuel conduits for delivery of fuel to the combustion air in the first and second series of discrete combustion air passages.

10. The nozzle assembly of claim 9, the fuel delivery hub comprising a first fuel delivery channel for delivery of fuel to the first fuel conduit and a second fuel delivery channel for delivery of fuel to the second fuel conduit.

11. The nozzle assembly of claim 9, the first fuel delivery channel having a first fuel volume and the second fuel delivery channel having a second fuel volume.

12. The nozzle assembly of claim 9, wherein the discrete combustion air passages extend at an angle to a central axis of the nozzle.

13. The nozzle assembly of claim 12, wherein the angled, discrete combustion air passages are operable to impart a swirl motion to fuel and combustion air mixture exiting the nozzle at the second, downstream end.

14. The nozzle assembly of claim 9, wherein the discrete combustion air passages extend parallel to a central axis of the nozzle.

15. The nozzle assembly of claim 14, wherein the discrete combustion air passages are configured to establish a fuel and combustion air mixture exiting the nozzle at the second, downstream end.

16. The nozzle assembly of claim 9, wherein the discrete combustion air passage outlets at the second, downstream end of the nozzle have blended edges operable to reduce flame holding at the downstream end of the nozzle.

17. A method for delivery of a fuel and combustion air mixture comprising:

delivering combustion air to a nozzle having discrete combustion air passages extending from a first, upstream end to a second, downstream end;

delivering fuel through a fuel delivery channel to a fuel distribution manifold disk attached to the first, upstream end of the nozzle having a central opening extending therethrough for receipt of the fuel delivery channel, and having discrete combustion air passages extending from a first, upstream end to a second, downstream end corresponding to, and in alignment with, the discrete combustion air passages in the nozzle;

channeling the fuel through fuel distribution grooves located in one end of the fuel distribution manifold disk, the fuel distribution grooves extending from the central opening to the discrete combustion air passages to define a fuel circuit;

and releasing the fuel from the fuel circuit and into the discrete combustion air passages to define a fuel and combustion air mixture.

18. The method for delivery of a fuel and combustion air mixture of claim 17, further comprising;

orienting the discrete combustion air passages at an angle to a central axis of the nozzle wherein the angled combustion air passages are operable to impart a swirl motion to the fuel and combustion air mixture exiting the nozzle at the second, downstream end.

* * * * *